US011014719B2

(12) United States Patent
Courtin

(10) Patent No.: US 11,014,719 B2
(45) Date of Patent: May 25, 2021

(54) END PIECE FOR DISPENSING FLUID HAVING BACTERICIDAL AND/OR BACTERIOSTATIC PROPERTIES

(71) Applicant: Karine Courtin, Boulogne-Billancourt (FR)

(72) Inventor: Karine Courtin, Boulogne-Billancourt (FR)

( * ) Notice: Subject to any disclaimer, the term of this patent is extended or adjusted under 35 U.S.C. 154(b) by 0 days.

(21) Appl. No.: 15/532,173

(22) PCT Filed: Dec. 2, 2015

(86) PCT No.: PCT/EP2015/078382
§ 371 (c)(1),
(2) Date: Jun. 1, 2017

(87) PCT Pub. No.: WO2016/087525
PCT Pub. Date: Jun. 9, 2016

(65) Prior Publication Data

US 2017/0267424 A1 Sep. 21, 2017

(30) Foreign Application Priority Data

Dec. 4, 2014 (FR) ..... 1461932

(51) Int. Cl.
*B65D 47/20* (2006.01)
*B65D 47/08* (2006.01)
(Continued)

(52) U.S. Cl.
CPC ..... *B65D 47/2031* (2013.01); *B65D 47/0838* (2013.01); *B65D 47/42* (2013.01); *B65D 81/24* (2013.01)

(58) Field of Classification Search
CPC ..... B65D 47/2031; B65D 47/0838; B65D 47/42; B65D 81/24
See application file for complete search history.

(56) References Cited

U.S. PATENT DOCUMENTS 2,855,933 A * 10/1958 Erikson ..... A61M 1/0011 604/415
4,234,103 A * 11/1980 Strobl, Jr. ..... B65D 47/0814 16/227
(Continued)

FOREIGN PATENT DOCUMENTS

EP 1 649 775 A1 4/2006
FR 2 791 955 A1 10/2000
(Continued)

OTHER PUBLICATIONS

Search Report issued in French Patent Application No. 14 61932 dated Jul. 17, 2015.
(Continued)

*Primary Examiner* — Vishal Pancholi
*Assistant Examiner* — Bob Zadeh
(74) *Attorney, Agent, or Firm* — Pearne & Gordon LLP

(57) ABSTRACT

An end piece (10) for dispensing a fluid product, having a dispensing orifice (16) that opens out at an application face (18) and having a movable cover (30) that is able to cover the dispensing orifice (16) and the application face (18), the cover (30) having a wall (48) intended to be facing to the application face (18) when the cover (30) is in a closed position, characterized in that the cover (30) has a layer (50) of bactericidal and/or bacteriostatic material which is affixed to the wall (48) of the cover (30) and which is in contact with the application face (18) when the cover (30) is in the closed position.

8 Claims, 3 Drawing Sheets

(51) Int. Cl.
*B65D 81/24* (2006.01)
*B65D 47/42* (2006.01)

(56) References Cited

U.S. PATENT DOCUMENTS 4,463,880 A * 8/1984 Kramer ..... B65D 47/42 222/189.08
4,579,823 A * 4/1986 Ryder ..... C12Q 1/22 116/307
4,902,482 A * 2/1990 Faust ..... A61L 2/10 422/121
4,961,502 A * 10/1990 Griffiths ..... G03C 3/003 206/455
5,105,993 A * 4/1992 La Haye ..... A61F 9/0008 210/321.89
5,269,429 A * 12/1993 Schumacher ..... B65D 51/002 215/249
5,360,145 A * 11/1994 Gueret ..... B05B 11/0005 222/190
5,373,972 A * 12/1994 Bystrom ..... A61F 9/0008 137/512
5,490,938 A * 2/1996 Sawan ..... A01N 25/24 210/321.84
5,648,084 A * 7/1997 Guttag ..... A61K 9/0048 424/400
5,681,468 A 10/1997 Sawan
5,869,073 A 2/1999 Sawan
6,824,015 B1 * 11/2004 Ammann ..... B65D 81/28 222/108
10,005,597 B2 * 6/2018 Courtin ..... B65D 47/2031
2003/0189065 A1 * 10/2003 Stull ..... B65D 47/0871 222/212
2005/0141951 A1 * 6/2005 Gueret ..... A45D 33/02 401/202
2006/0065673 A1 * 3/2006 Miyazaki ..... B65D 47/2031 222/96
2006/0083577 A1 4/2006 Gueret
2006/0197042 A1 * 9/2006 Kneer ..... B65D 47/205 251/82
2007/0093765 A1 * 4/2007 Kawashiro ..... A61F 9/0008 604/295
2008/0237271 A1 * 10/2008 Olechowski ..... B65D 47/2031 222/494
2010/0108712 A1 * 5/2010 Manesis ..... A61F 9/0008 222/1
2011/0125111 A1 * 5/2011 Chibret ..... A61F 9/0008 604/300
2012/0199119 A1 * 8/2012 Pardonge ..... B05B 11/0005 128/200.22
2013/0061874 A1 * 3/2013 Woolery ..... B08B 1/00 134/6
2013/0134186 A1 * 5/2013 Defemme ..... B65D 47/18 222/321.1
2016/0244223 A1 8/2016 Courtin
2017/0267424 A1 * 9/2017 Courtin ..... B65D 81/24

FOREIGN PATENT DOCUMENTS

JP 10264954 * 10/1998 ..... B65D 47/2031
WO 2013/039482 A1 3/2013

OTHER PUBLICATIONS

International Preliminary Report on Patentability issued in Application No. PCT/EP2015/078382 dated Jul. 20, 2016.
International Search Report issued in Application No. PCT/EP2015/078382 dated Jan. 22, 2016.
Written Opinion issued in Application No. PCT/EP2015/078382 dated Jan. 22, 2016.

* cited by examiner

END PIECE FOR DISPENSING FLUID HAVING BACTERICIDAL AND/OR BACTERIOSTATIC PROPERTIES

TECHNICAL DOMAIN

The invention relates to an end piece for dispensing fluid having a cover that confers bactericidal and/or bacteriostatic properties on it.

Such a dispensing end piece is particularly advantageous for an application for example for dispensing cosmetics, pharmaceutical or food products that are intended to come into contact with the skin. The end piece makes it possible to dispense a product with no risk of contaminating the product.

STATE OF PRIOR ART

Many fluid products, in other words fluids that are in paste or liquid form, are contained in a receptacle that preserves the product and is also used to dispense it.

The product is usually preserved by means of a receptacle hermetically sealed to air and also by introducing preserving agents, anti-oxidants, bactericides, etc. into the product.

Another source of pollution of the product is at the dispensing device. The dispensing device comprises a product outlet opening at which air can penetrate inside the container and pollute the product.

The product is also drawn off by wiping the external surface of the device, for example with a finger, the tongue or any other part of the human body. This wiping action places bacteria or other polluting elements onto the outer surface, and also disseminates them.

A dispensing end piece is the interface between the reservoir containing the product to be dispensed and the user who draws off this product.

The end piece comprises a dispensing orifice for this purpose opening up both in the reservoir and on a drawing off face of the end piece, and the product to be drawn off exits from the reservoir through this orifice.

The drawing off face forms the interface at which the user accesses the product.

This drawing off face is exposed to the open air and to contact with many surfaces such as a user's finger.

Each of these exposures of the drawing off face implies a risk of contamination of this face, and a risk that the contaminant will be transferred to the drawn off product.

Document FR-A-2.791.955 discloses a dispensing end piece comprising a removable cover and a dispensing orifice closing element that can come into contact with a part of the drawing off face.

According to this document, the closing element comprises a bactericide/bacteriostatic substance that treats the product remaining at the orifice.

However, it is particularly difficult to make and to use such a closing element, which consequently increases the cost of manufacturing the dispensing end piece. Moreover, this document does not provide any information about the nature, the concentration or the homogeneity of the bactericide element.

Furthermore, the closing element may be subject to risks of wear, such that its contact with the drawing off face is no longer optimal, or the quantity of bactericide/bacteriostatic substance contained in it can reduce as it is used.

The purpose of the invention is to disclose a dispensing end piece with bactericide/bacteriostatic properties that are constant throughout the usage period of the reservoir on which the end piece is fitted.

PRESENTATION OF THE INVENTION

The invention discloses an end piece for dispensing a fluid product, having a dispensing orifice that opens at an application face and having a movable cover that is able to cover the dispensing orifice and the application face, the cover having a wall designed face to the application face when the cover is in a closed position, characterized in that the cover has a layer of bactericidal and/or bacteriostatic material which is affixed to the wall of the cover and which is in contact with the application face when the cover is in the closed position.

Deposition of a layer of bactericide/bacteriostatic material on the cover facilitates the manufacturing process of the end piece. Furthermore, the material does not lose its bactericide/bacteriostatic properties during use.

Preferably, the dispensing orifice is closed off by a slit stopper.

Preferably, the layer of bactericide and/or bacteriostatic material consists of a metal plate glued to the wall of the cover.

Preferably, the layer of bactericide and/or bacteriostatic material consists of a layer of said material deposited on the wall of the cover.

Preferably, the layer of bactericide and/or bacteriostatic material is made from copper or silver or any other bactericide and/or bacteriostatic alloy.

Preferably, the cover is removable.

Preferably, the cover is hinged to a body of the end piece in which the dispensing orifice is formed.

Preferably, the shapes of the application face and a face of the layer of bactericide and/or bacteriostatic material facing the application face are identical.

Preferably, the application face and said face of the layer of bactericide and/or bacteriostatic material are flat.

Preferably, the application face and said face of the layer of bactericide and/or bacteriostatic material are concave or convex.

BRIEF DESCRIPTION OF THE DRAWINGS

Other characteristics and advantages of the invention will become clear after reading the following detailed description that will be better understood by referring to the appended figures among which.

DETAILED PRESENTATION OF PARTICULAR EMBODIMENTS

Figure 1:
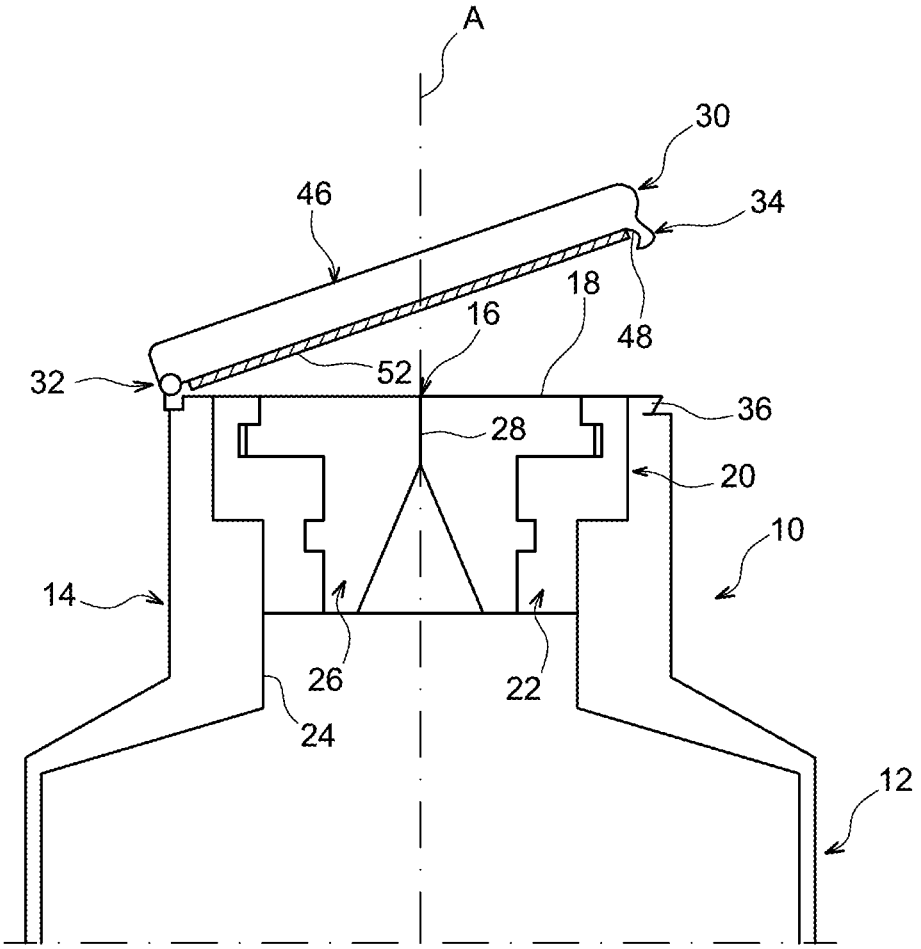
FIG. 1 is an axial section of a dispensing end piece according to the invention, in which the cover of the end piece is shown in the open position in which the product can be drawn off.
Figure 2:
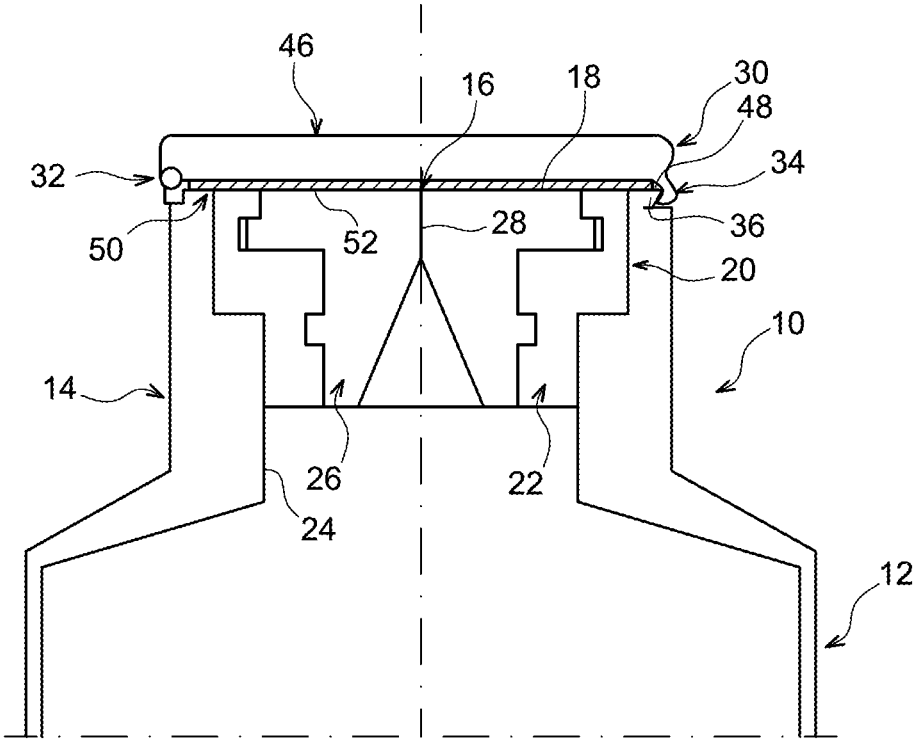
FIG. 2 is a view similar to the view in FIG. 1, showing the end piece cover in the closed position.

FIGS. 1 and 2 show an end piece 10 for dispensing a fluid such as, for example, a paste, a cream, a gel or a liquid solution.

In this case, the end piece 10 forms part of a receptacle 12 inside which the product to be dispensed is contained. For example, the receptacle 12 might consist of a tube made from a semi-rigid or soft elastic material, or the receptacle 12 might consist of rigid receptacle such as a pot.

The dispensing end piece 10 comprises a main body 14 with its axis oriented along the principal axis A of the end piece 10.

The body 14 comprises a dispensing orifice 16, through which fluid can exit from the receptacle 12 through the end piece 10, and an application face 18 onto which the distribution orifice opens up.

The user draws off fluid outlet through the orifice 16 at the application face 18, for example by passing his or her finger on the application face 18.

In the embodiment shown on the figures, the dispensing orifice 16 will be closed off by a slit stopper to hermetically close the dispensing orifice 16.

The slit stopper 20 comprises a main frame 22 that fits into a complementary housing 24 formed in the main body 14, and a deformable element 26 mounted in the frame 22.

A slit 28 is formed in the deformable element, extending parallel to the principal axis A of the end piece 10.

When pressure is applied on the walls of the receptacle, the fluid pressure increases and the deformable element 26 is designed such that the slit 28 opens under the action of the fluid pressure to open the dispensing orifice 16 and consequently allows a certain quantity of fluid to exit through the dispensing orifice under the action of this pressure.

When the pressure on the walls of the receptacle 12 is released, the deformable element elastically returns to its initial configuration in which the dispensing orifice 16 is hermetically closed.

Such a slit stopper 20 prevents contamination of the fluid contained in the receptacle by air and other contaminants such as bacteria.

The dispensing end piece 10 also comprises a removable cover 30 that is free to move relative to the principal body 14 between a closed position of the dispensing orifice 16 shown on FIG. 2 in which the cover 30 covers the dispensing orifice 16 and the application face 18, and an open position shown in FIG. 1 in which the cover 30 allows access to the application face 18 and the orifice 16.

The cover 30 comprises mainly a closing wall 46 that faces and is preferably in contact with the application face 18. This closing wall comprises a face 48 facing the application face 18 that has a shape complementary to the application face 18. In this case, the application face 18 is plane, and consequently the face 48 of the closing wall 46 is also plane.

It will be understood that the invention is not limited to this shape of the application face 18 and the face facing the closing wall 46, that may also be concave or convex.

According to the embodiment shown on FIGS. 1 and 2, the cover 30 is hinged about the main body 14 of the end piece 10.

Preferably, the means 32 forming the hinge of the cover 30 relative to the body 14 are located at the corresponding first edges of the cover 30 and the body 14, that in this case are located at the left side of FIGS. 1 and 2.

The cover 30 and the body 14 also comprise means of blocking the cover 30 in the closed position.

These blocking means are preferably means of blocking by elastic force fitting, or click fitting, and comprise an elastic hook 34 fitted on a second edge of the cover 30 opposite the first edge of the cover 30 on which the hinge means 32 are fitted. When the cover 30 is in the closed position, the elastic hook 34 cooperates with an associated tooth 36 formed on the second edge of the body 14 that is opposite the first edge of the body 14 on which the hinge means 32 are fitted.

Figure 3:
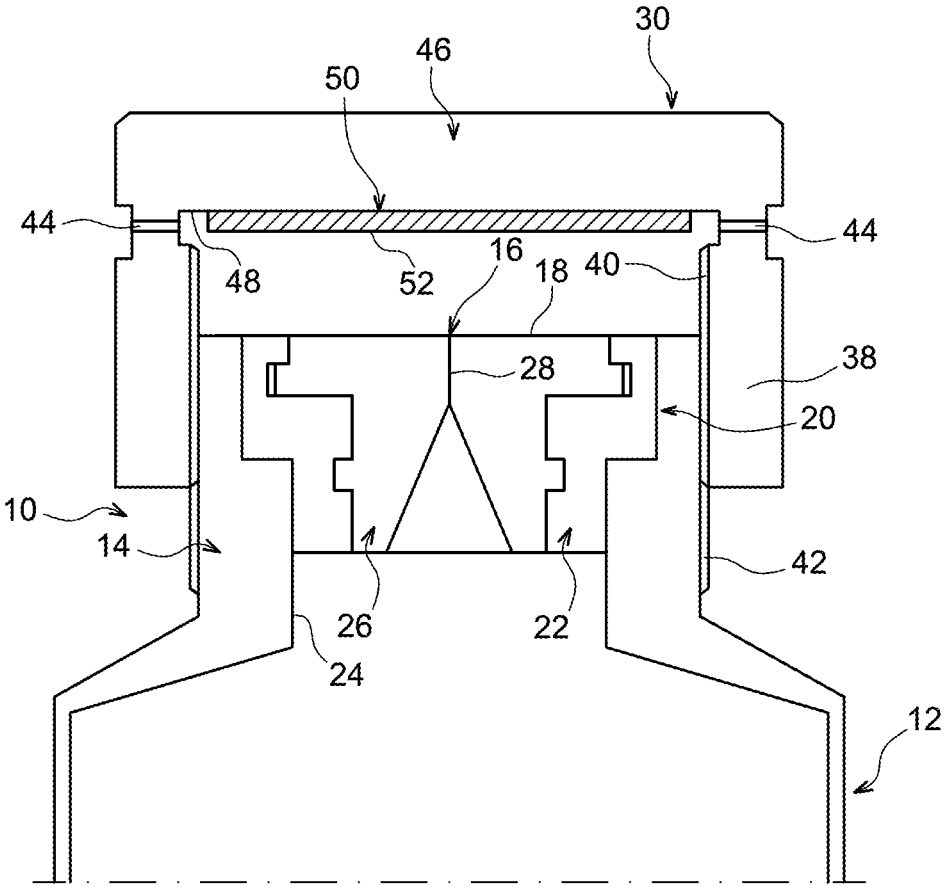
FIG. 3 is an axial section of another embodiment of the end piece in which the cover can be screwed onto the body of the end piece.

According to another embodiment shown on FIG. 3, the cover 30 is installed on the body 14 by screwing.

To achieve this, the cover 30 comprises a cylindrical wall 38 that prolongs the edges of the closing wall 46 in the axial direction and on the internal face of which a thread 40 is formed capable of cooperating with a complementary thread 42 formed on the outer cylindrical wall of the body 14. The cylindrical wall 38 of the cover comprises vents 44 allowing air trapped between the cover and the body 14 to escape to the outside when the cover 30 is screwed in.

The application face 18 is in extended contact with air and might received contaminants such as bacteria, particularly when the user comes into contact with it while drawing off fluid present on the application face 18.

Contaminants deposited on the application face 18 can then be transferred to the fluid the next time that the product dispenser is used.

In order to destroy these contaminants and particularly bacteria that could develop on the application face 18 between two uses, the end piece comprises a layer of bactericide/bacteriostatic material 50 with bactericide and/or bacteriostatic properties and that can come into contact with the application face 18.

According to one preferred embodiment, the layer of bactericide/bacteriostatic material 50 is fitted on the cover 30.

Thus, closing and opening the cover will bring the layer of bactericide/bacteriostatic material 50 into contact with the application face, or separate it from the application face, respectively.

Preferably, the layer of bactericide/bacteriostatic material 50 is located on the face 48 of the closing wall 46 of the case 30. Thus, when the case 30 is in the closed position as shown on FIG. 2, the layer of bactericide/bacteriostatic material 50 is in contact with the application face 18, so that contaminants can be destroyed.

Also in this case, the shape of the layer of bactericide/bacteriostatic material 50, and more precisely the shape of its face 52 facing the application face 18, is complementary to the shape of the application face 18.

In this case, the application face 18 is plane, and consequently the face 52 of the layer of bactericide/bacteriostatic material 50 is also plane.

It will be understood that the invention is not limited to this shape of the application face 18 and the face 52 of the layer of bactericide/bacteriostatic material 50, that may also be concave or convex.

Preferably, the layer of bactericide/bacteriostatic material 50 is composed of copper or silver, that are naturally bactericide/bacteriostatic materials, or may be based on any bactericide alloy, and particularly an alloy based on copper and/or silver. Thus, the layer of bactericide/bacteriostatic material 50 does not lose its properties during use. Furthermore, these materials are inexpensive and easy to use compared with special bactericide/bacteriostatic compositions that have to be developed in the laboratory.

According to a first embodiment, the layer of bactericide/bacteriostatic material 50 consists of a thin plate that is glued onto said face 48 of the closing wall 46 of the case 30.

According to another embodiment, the layer of bactericide/bacteriostatic material 50 is deposited on said face 48 of the closing wall 46 of the case 30. With this embodiment, only a small but sufficient quantity of bactericide/bacteriostatic material is used.

What is claimed is:

1. End piece (10) for dispensing a fluid product, wherein the end piece (10) comprises a main body (14) in an upper portion of the end piece (10) and a receptacle (12) in a lower portion of the end piece (10) in which the fluid product is contained, wherein the main body (14) comprises: a dispensing orifice (16) through which fluid can exit from the receptacle (12) and that opens out at an application face (18); and a movable cover (30) that is coupled to the upper portion of the end piece and is able to cover the dispensing orifice (16) and the application face (18), the cover (30) having a wall (48) intended to be facing the application face (18) when the cover (30) is in a closed position, characterized in that the cover (30) has a layer (50) consisting of bactericidal and/or bacteriostatic material which is affixed to the wall (48) of the cover (30) and which is in contact with the application face (18) when the cover (30) is in the closed position;

wherein the dispensing orifice (16) is closed off by a slit stopper (20); and the slit stopper comprises a main frame (22) that fits entirely into a complementary housing (24) formed in the main body (14) of the end piece (10) and a deformable element (26) is mounted in the main frame, the main frame (22) and the deformable element (26) being separate elements.

2. Dispensing end piece (10) according to claim 1, characterized in that the layer (50) of bactericide and/or bacteriostatic material consists of a metal plate glued to the wall (48) of the cover (30).

3. Dispensing end piece (10) according to claim 1, characterized in that the layer (50) of bactericide and/or bacteriostatic material is deposited on the wall (48) of the cover (30).

4. Dispensing end piece (10) according to claim 1, characterized in that the layer (50) of bactericide and/or bacteriostatic material is made from copper or silver or any other bactericide and/or bacteriostatic alloy.

5. Dispensing end piece (10) according to claim 1, characterized in that the cover (30) is removable.

6. Dispensing end piece (10) according to claim 1, characterized in that the cover (30) is hinged to the main body (14) of the end piece (10) in which the dispensing orifice (16) is formed.

7. Dispensing end piece (10) according claim 1, characterized in that shapes of the application face (18) and a face (52) of the layer (50) of bactericide and/or bacteriostatic material facing the application face (18) are identical.

8. End piece (10) for dispensing a fluid product, wherein the end piece (10) comprises a main body (14) in an upper portion of the end piece (10) and a receptacle (12) in a lower portion of the end piece (10) in which the fluid product is contained, wherein the main body (14) comprises: a dispensing orifice (16) through which fluid can exit from the receptacle (12) and that opens out at an application face (18); and a movable cover (30) that is coupled to the upper portion of the end piece and is able to cover the dispensing orifice (16) and the application face (18), the cover (30) having a wall (48) intended to be facing the application face (18) when the cover (30) is in a closed position, characterized in that the cover (30) has a layer (50) consisting of bactericidal and/or bacteriostatic material which is affixed to the wall (48) of the cover (30) and which is in contact with the application face (18) when the cover (30) is in the closed position and that the application face (18) and said face (52) of the layer (50) of bactericide and/or bacteriostatic material are plane; and characterized in that the dispensing orifice (16) is closed off by a slit stopper (20); and the slit stopper comprises a main frame (22) that fits entirely into a complementary housing (24) formed in the main body (14) of the end piece (10) and a deformable element (26) that is mounted in the main frame and that is planar coincident with the application face when closed, wherein the main frame (22) and the deformable element (26) are separate elements.

* * * * *